US007934815B2

(12) United States Patent
Brick et al.

(10) Patent No.: US 7,934,815 B2
(45) Date of Patent: May 3, 2011

(54) EXTERNAL FLUID MANIFOLD WITH POLYMER COMPLIANT WALL

(75) Inventors: Jonathan R. Brick, Tualatin, OR (US); Rodney B. Hill, Mt. Angel, OR (US); Terrance L. Stephens, Molalla, OR (US); John R. Andrews, Fairport, NY (US); David P. Platt, Newberg, OR (US); Andrew M. Sadowski, Durham, NC (US)

(73) Assignee: Xerox Corporation, Norwalk, CT (US)

( * ) Notice: Subject to any disclaimer, the term of this patent is extended or adjusted under 35 U.S.C. 154(b) by 435 days.

(21) Appl. No.: 12/194,472

(22) Filed: Aug. 19, 2008

(65) Prior Publication Data

US 2010/0045737 A1 Feb. 25, 2010

(51) Int. Cl.
*B41J 2/045* (2006.01)

(52) U.S. Cl. ..... 347/71

(58) Field of Classification Search ..... 347/40, 347/43, 70, 71, 64, 65
See application file for complete search history.

(56) References Cited

U.S. PATENT DOCUMENTS 6,592,216 B2 * 7/2003 Slenes et al. ..... 347/94
6,955,419 B2 * 10/2005 Andrews et al. ..... 347/70

* cited by examiner

*Primary Examiner* — Lamson D Nguyen
(74) *Attorney, Agent, or Firm* — Marger Johnson & McCollom, P.C.

(57) ABSTRACT

A fluid dispensing assembly having a fluid dispensing subassembly to deliver fluid to a substrate, an external manifold to supply fluid having a first wall arranged adjacent to the fluid dispensing subassembly, and a compliant wall attached to a second wall arranged opposite the first wall, the compliant wall to confine the fluid to chambers in the manifold and to provide compliance for acoustic attenuation. A fluid dispensing assembly having an external manifold having at least one opening in a back side opposite a fluid dispensing subassembly side, the fluid dispensing subassembly side being in contact with fluid, and a compliant wall adhered to the external manifold on the back side. A method of manufacturing a fluid dispensing assembly having forming an external manifold having openings to receive fluid, attaching a compliant wall to the external manifold such that the compliant wall seals the openings, and attaching the external manifold to a fluid dispensing subassembly wherein the fluid dispensing subassembly and manifold are on opposite sides of a transducer arranged to operate on the fluid in the manifolds.

23 Claims, 4 Drawing Sheets

EXTERNAL FLUID MANIFOLD WITH POLYMER COMPLIANT WALL

BACKGROUND

Some fluid dispensing assemblies use transducers or actuator to cause the system to dispense fluid. The actuators may be piezoelectric actuators, microelectromechanical (MEMS) actuators, thermomechanical actuators, thermal phase change actuators, etc. The actuators generally cause some sort of interface with the fluid to move to generate pressure in the fluid that in turn causes the fluid to move through an aperture to a receiving substrate.

In addition to causing the assembly to dispense or dispel fluid, the actuators may also create pressure oscillations that propagate into the fluid supply. These pressure oscillations give rise to droplet position errors, missing droplets, etc.

One example of such a fluid dispensing system is an ink jet printer. Generally, ink jet printers include some sort of transducer or actuator that cause the ink to move out of the print head through a jet, nozzle or other orifice to form a drop on a print surface. Pressure oscillations result in position errors, affecting the accuracy of the resulting print, missing ink droplets, affecting the color density of the print, and color density bands in prints.

DETAILED DESCRIPTION OF THE EMBODIMENTS

Some fluid dispensing assemblies include a local ink supply and a fluid dispensing subassembly. The fluid dispensing subassembly may be viewed as having several components. First, the driver component may consist of the transducer, such as a piezoelectric transducer, that causes the fluid to exit the subassembly, the diaphragm upon which the transducer operates, and the body plate or plates that form the pressure chamber. Second, an inlet component consists of the manifold body that direct the fluid from the manifold toward the pressure chamber. Next, the outlet component directs the fluid from the pressure chamber to the aperture. Finally, the aperture itself dispenses fluid out of the printhead.

One example of a fluid dispensing subassembly is a jet stack in a printhead, the jet stack typically consisting of a set of plates bonded together. In this example, the driver would operate to cause the fluid to exit the jet stack through the aperture plate. The inlet would direct the fluid from the manifold towards the pressure chamber, and the outlet would direct the ink from the pressure chamber to the aperture plate. In the example of a jet stack, the aperture would dispense fluid out of the jet stack and ultimately out of the print head.

Figure 1:
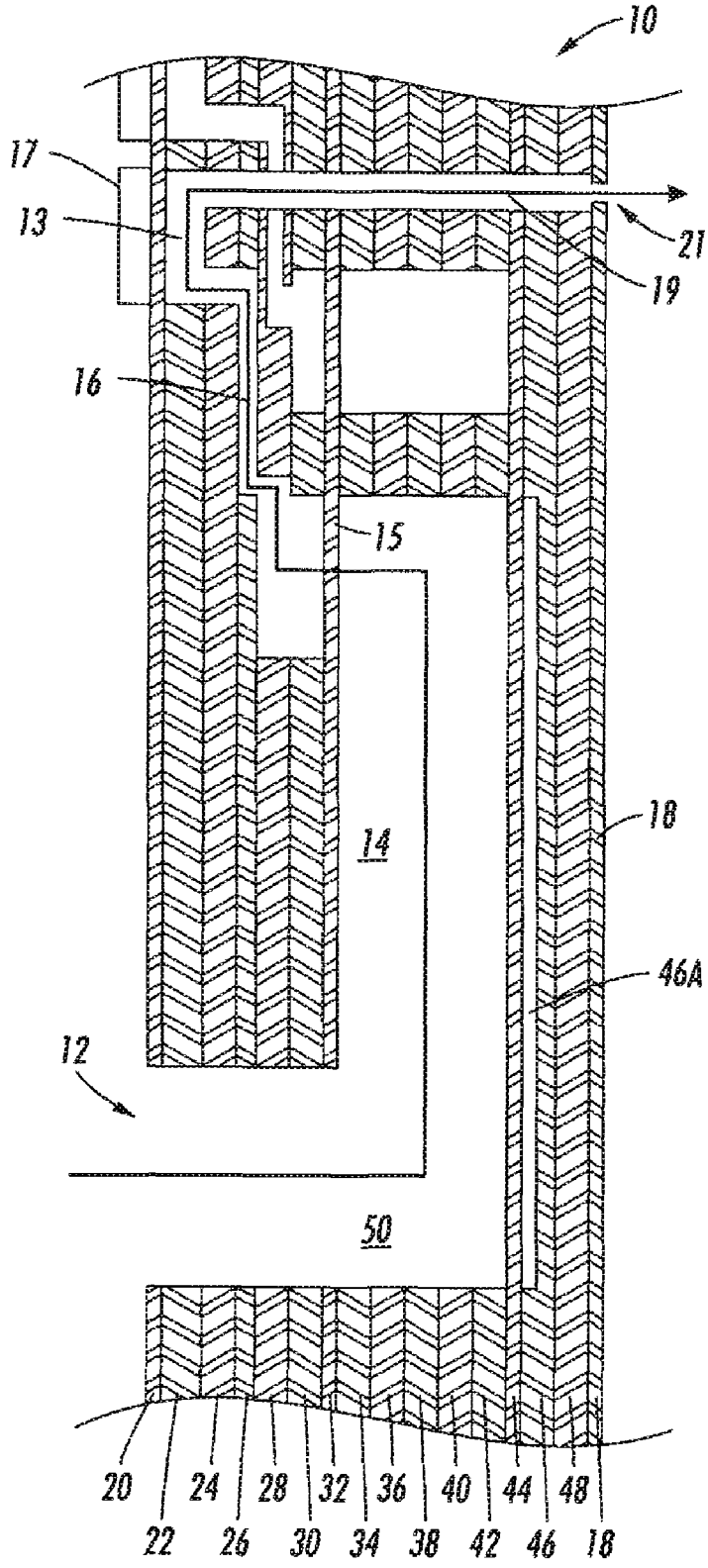
FIG. 1 shows an example of a fluid dispensing subassembly having a steel compliant wall and air gaps.

FIG. 1 shows an example of a jet stack in a printhead. The jet stack 10 consists of a set of plates bonded together in this example and will be used in the discussion. It should be noted that this is just an example and no limitation to application or implementations of the invention claimed here. As will be discussed further, the terms 'printer' and 'printhead' may consist of any system and structure within that system that dispenses fluid for any purpose. Similarly, while a jet stack will be discussed here to aid in understanding, any fluid dispensing subassembly may be relevant. The fluid dispensing subassembly or fluid dispensing body may be comprised of a set of plates, as discussed here, a molded body that has the appropriate channels, transducers, and apertures, a machined body, etc. As aspects of the embodiments include additional structures inside the jet stack than just the plates, the set of plates may be referred to as the fluid dispensing body within the fluid dispensing subassembly.

The jet stack receives ink from a reservoir (not shown) through a port 12. The ink flows through the manifold 14 having a compliant wall 44 and an air space 46A opposite the manifold, through a particle filter 15 and into to an inlet 16. The inlet directs liquid to a pressure chamber 13. When an actuator or transducer 17 activates, it causes the diaphragm plate 20 to deflect, and causes ink to flow through the outlet 19 and exit an aperture 21 on the aperture plate 18. The ink drops exiting the aperture form a portion of a printed image. The aperture plate 18 and the compliant wall 44 on the interior of the jet stack will typically be steel plates. The part of the ink path that includes the inlet, the pressure chamber, actuator, outlet, and aperture is referred to as the "single jet".

The actuator, in addition to providing the pressure that forces ink out the apertures, also directs pressure oscillations back through the inlet and into the manifold. The pressure oscillations from several jets attached to the manifold can lead to larger amplitude pressure oscillations that then in turn influence the ejection of drops in the same and other drop ejectors. The manifold pressure oscillations lead to print defects such as banding and missing or misplaced drops.

The series or set of plates are etched, stamped or otherwise manufactured to form the various channels, chambers and features of the jet stack. In this example, the stack consists of a diaphragm plate 20; body plate 22; a separator plate 24; an inlet plate 26; separator plates 28 and 30; a particle filter plate 32; and manifold plates 34, 36, 38, 40, and 42; a compliant wall plate 44, a plate 46 providing an air space adjacent to the compliant wall, an aperture brace 44 and an aperture plate 18.

When the jet stack is made up from a series of bonded metal plates, a thin, stainless steel plate can form one wall of the manifolds internal to the jet stack. An air gap is generally provided next to the stainless steel plate opposite to the manifold to dissipate the pressure oscillations. The ability of the manifold wall to flex is called compliance and is thus referred to as a compliant wall. An example of this approach is demonstrated by US Patent Application Publication No. 2002/0196319.

However, because of it's high Young's modulus (~200 GPa), the bonded stainless steel wall generally does not provide enough compliance, resulting in a need for larger compliant regions in the jet stack and more complex manifold shapes. This structure generally includes acoustic filters built into the jet stack using etched plates to form chambers inside the jet stack. An example of this approach is demonstrated in U.S. Pat. No. 6,260,963.

Figure 2:
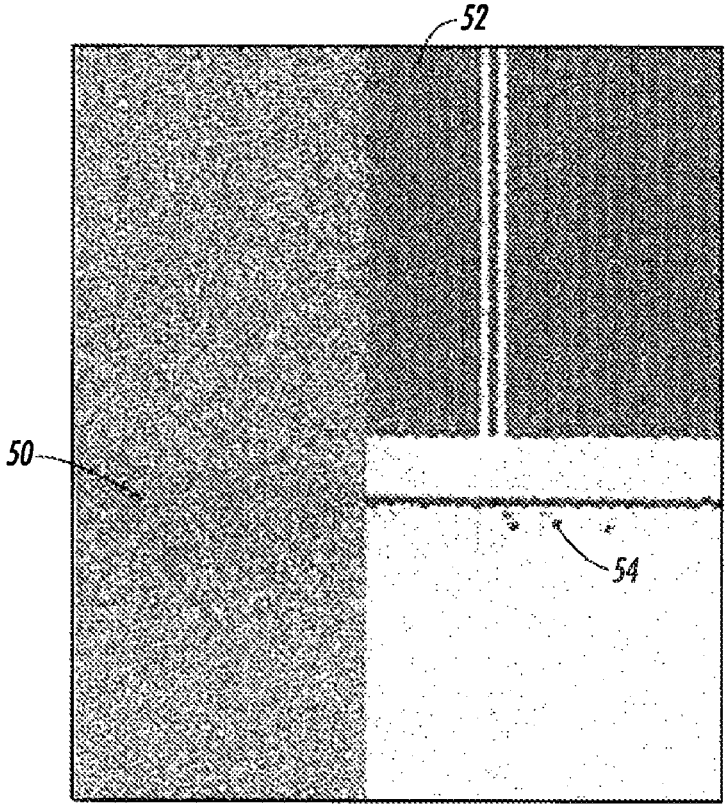
FIG. 2 shows an example of a print having banding and jet drop out in a jet stack without compliance.

FIG. 2 shows an example image resulting from the example fluid dispensing assembly of a printhead without compliance. The region 50 shows a horizontal band where a higher density of ink is deposited relative to adjoining regions, causing the darker band in the image. Region 52 shows a jet failure (vertical blank lines), where the jet has completely dropped out of operation. Region 54 shows another jet failure where a line would be of a different color. If, for example, the gray areas on the image were cyan, the line shown in region 54 would be magenta, as the cyan jets would have dropped out.

Figure 3:
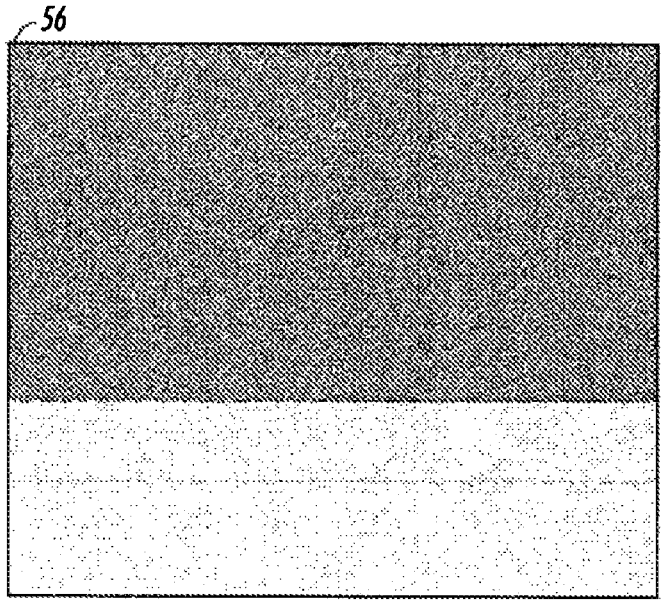
FIG. 3 shows an example of a print from a jet stack having compliance.

In contrast, FIG. 3 shows an image 56 resulting from a fluid dispensing assembly having a fluid dispensing subassembly, in this case a jet stack, having compliance. There is no density banding, or the density banding is at such a resolution as to be undetectable to the human eye. Further, there is no jet drop out that had resulted in the streaks in the previous image. Even further, the cyan jets did not drop out, leaving a streak of another color. This image resulted from compliance being added to the system.

In one implementation, the compliance is added to the system using a compliant wall that is the outer layer to an external manifold. The term 'external manifold' as used here means an ink manifold that is separate from the thin bonded plates that normally make the jet stack and where the jet stack and manifold are on opposite sides of the transducers rather than one of the plates on the same side of the transducer as the apertures as described in FIG. 1.

Figure 4:
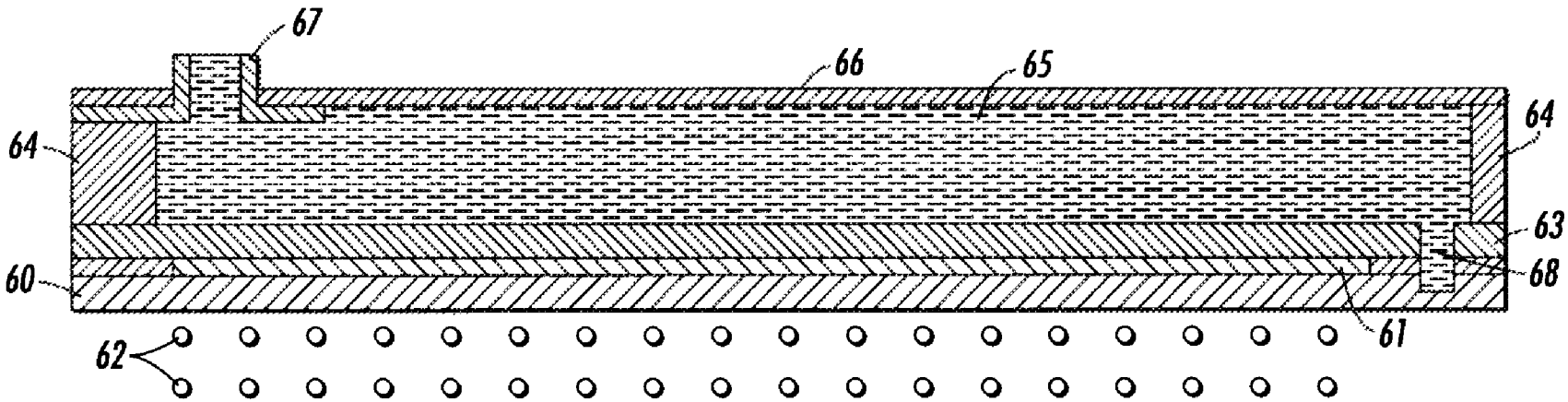
FIG. 4 shows an embodiment in cross section of a fluid dispensing assembly having a fluid dispensing subassembly, an external manifold and a compliant wall adhered to the external manifold.

FIG. 4 shows an example of such a printhead in cross section, having an external manifold with a compliant wall. The jet stack 60 contains the ink routing channels, pressure chamber, and exit apertures that are not shown in detail. The piezo electric transducers 61 generate the pressure that ejects liquid droplets 62 from the apertures (not shown). Other types of transducers may also be used, including acoustic, microelectromechanical, etc. The electrical interconnect 63 can be a flexible circuit or semirigid circuit board. A conductive adhesive, mechanical contact, or solder provide electrical continuity between the array of electrical elements in the electrical interconnect and the elements of the transducer array. The external manifold defined by walls 64 sits on the opposite side of the transducers 61 from the jet stack 60. The external manifold contains manifold chambers 65 that provide an immediate fluid supply to the jet stack. The compliant wall 66 forms one wall of the manifold chambers and is at least partly unconstrained so that it can provide the compliance needed to attenuate acoustic energy. An ink port inlet 67 provides a means to supply fluid to the printhead from a source and the ink outlet port 68 provides a path from the external manifold chambers into the jet stack.

Figure 5:
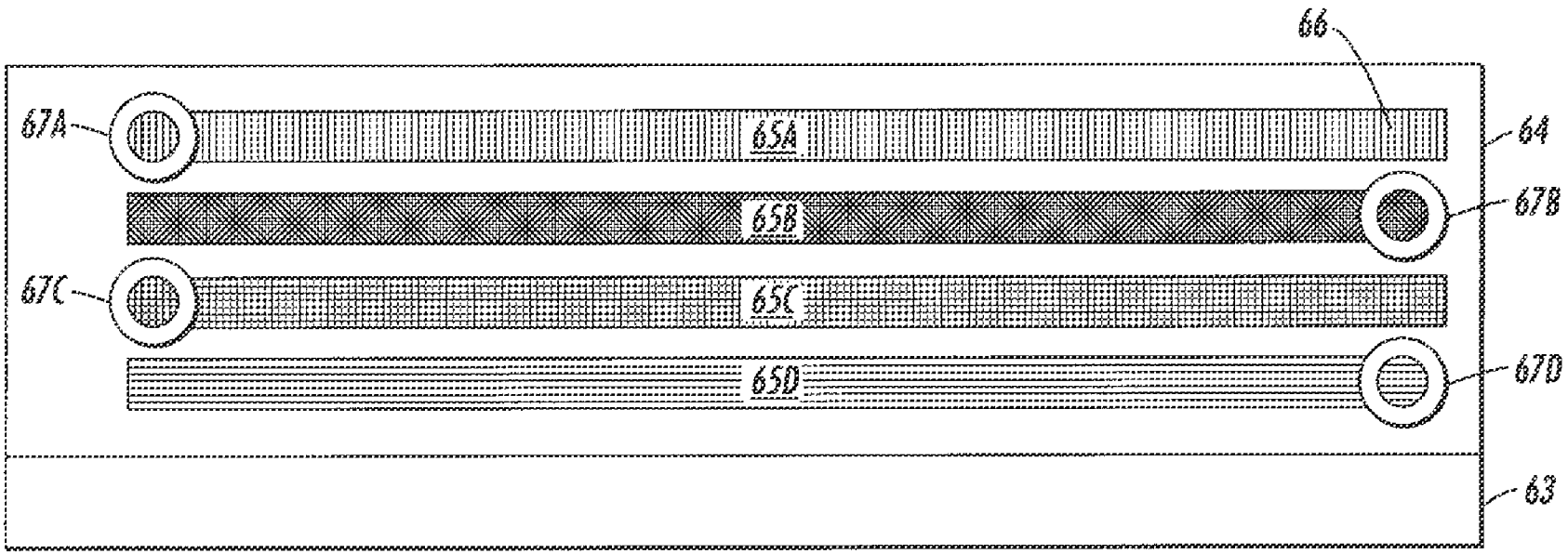
FIG. 5 shows a plan view of a fluid dispensing assembly from the side of the external manifold.

A plan view of the printhead from the side of the external manifold is shown in FIG. 5. The external manifold 64 contains 4 manifold chambers 65 A-D and inlet ports 67A-D that provide fluid paths from external fluid supplies into the manifold chambers. The compliant wall 66 is the cover layer in this plan view that provides a compliant wall for each of the manifold chambers. For a color printer these could be for the inks having 3 primary colors and black. In other embodiments at least 1 manifold chamber is included and a much larger number could also be included In a preferred embodiment, the compliant wall is formed from a thin polymer. The polymers, having relatively low Young's modulus (<10 GPa) in thin layers of 20 μm to 150 μm provide high compliance and therefore high attenuation of acoustic energy. Examples of polymers include polyimide, polycarbonate, polyester, polyetheretherketone, polyetherimide, polyethersulfone, polysulfone, silicone rubber or liquid crystal polymer. In other embodiments, the compliant wall may be formed of stainless steel, aluminum, or another metal. The large Young's modulus for the metals, approximately 70 GPa-210 GPa does not provide as much compliance, but in some cases may be sufficient while providing resistance to chemicals that may be in the fluids or stability to higher temperatures.

The manifold compliant wall provides at least one wall for each of the manifold chambers 65A-D. Current implementations have manifolds on the interior of the jet stack, so the use of the external manifold provides a unique opportunity for an ink supply with low fluid resistance for high speed printing. The use of the external manifold also makes it relatively easy to have the wall of the manifold to be flexible enough to provide substantial compliance, and therefore acoustic energy attenuation to the manifold. The manifolds in the regions 65A-D may be formed by cutting or casting a metal manifold or by molding a polymer manifold, the polymer manifold may be molded to include the openings. Using a flexible and/or elastic compliant wall increases the advantage provided by the openings. The external manifold chambers provide more area to be used for compliance rather than the tighter restrictions within the jet stack. This is especially true in jet stacks that have much higher jet densities, adding further constraints to the space inside the jet stack.

Thermoset or thermoplastic adhesives could also be used to bond the compliant wall to the manifold, depending on the constituents of the fluid and the desired operating temperature. For example, the compliant wall could be adhered using a b-stage (partially cured) acrylic thermo-set adhesive. Many different adhesives may be used, including an acrylic thermoset adhesive, acrylic, silicone, epoxy, bismaleimide, cyanoacrylate, thermoset polyimide and thermoplastic polyimide, as well as other thermoplastic adhesives.

An alternative approach to forming the external manifold with a compliant wall would be to do an insert mold in which the compliant wall is inserted into a mold in which the manifold body is injection molded.

Using a compliant wall having relatively low stiffness allows the wall to deflect and retract in the areas over the regions 65 A-D. The ink supply and the external manifolds may be held at a slightly negative pressure through the ink ports 67A-D.

Generally, materials having a low Young's modulus would provide the best compliance. A Young's modulus of 50 GigaPascals (GPas) would be suitable, but there are also several materials available that have a Young's modulus of less than 10 GPa. The low modulus allows for narrower channels in the ink supply, as the larger area is no longer needed to assist in attenuation of acoustic energy. In one example, the ink channels could be less than 1 millimeter (mm) wide.

When implemented, this design proved to be extremely successful, as indicated by the image of FIG. 3 compared to the image of FIG. 2.

It must be noted that the examples discussed herein are directed to ink and a jet stack referred to being a part of a printer. The term printer as used here applies to any type of drop-on-demand ejector system in which drops of fluid are forced through one aperture in response to actuation of some sort of transducer. This includes printers, such as thermal ink jet printers, printheads used in applications such as organic electronic circuits, bioassays, three-dimensional structure building systems, etc. The term 'printhead' is not intended to only apply to printers and no such limitation should be implied. Similarly, the above discussion has focused on ink as the dispensed fluid, but other types of fluids may also be dispensed.

For example, the above discussion may be viewed as a particular example of a fluid dispensing assembly having a fluid dispensing subassembly with a polymer, compliant aperture film. The fluid dispensing assembly has a local fluid supply provided to the fluid dispensing subassembly. The fluid dispensing subassembly in turn dispenses the fluid through a polymer aperture film, where the polymer aperture film also mitigates the effects of pressure oscillations in the fluid supply caused by operation of the transducers.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A fluid dispensing assembly, comprising:

a fluid dispensing subassembly to deliver fluid to a substrate;

an external manifold to supply fluid having a first wall arranged adjacent to the fluid dispensing subassembly; and a compliant wall attached to a second wall arranged opposite the first wall, the compliant wall to confine the fluid to chambers in the manifold and to provide compliance for acoustic attenuation.

2. The fluid dispensing assembly of claim 1, wherein the external manifold comprises one of either a metal manifold or a molded polymer manifold.

3. The fluid dispensing assembly of claim 1, wherein the external manifold includes at least one opening on the side opposite the fluid dispensing subassembly, the opening being sealed by the compliant wall.

4. The fluid dispensing assembly of claim 1, wherein the compliant wall comprises a polymer film.

5. The fluid dispensing assembly of claim 1, wherein the compliant wall has a Young's modulus of less than 50 GPa.

6. The fluid dispensing assembly of claim 1, wherein the compliant wall has a Young's modulus of less than 10 GPa.

7. The fluid dispensing assembly of claim 1, wherein the compliant wall is comprised of one of the group consisting of: polyimide, polycarbonate, polyester, polyetheretherketone, polyetherimide, polyethersulfone, polysulfone, and liquid crystal polymer.

8. The fluid dispensing assembly of claim 1, wherein the compliant wall is attached to the external manifold with adhesive.

9. The printhead of claim 8 wherein the compliant wall is attached with a thermoset adhesive.

10. The printhead of claim 8 wherein the compliant wall is attached with a thermoplastic adhesive.

11. The printhead of claim 8, wherein the adhesive comprises one of the group consisting of: an acrylic thermo-set adhesive, acrylic, silicone, epoxy, bismaleimide, and thermoplastic polyimide.

12. A fluid dispensing assembly, comprising:

an external manifold having at least one opening in a back side opposite a fluid dispensing subassembly side, the fluid dispensing subassembly side being in contact with fluid; and a compliant wall adhered to the external manifold on the back side.

13. The fluid dispensing assembly of claim 12, wherein the compliant wall is comprised of one of the group consisting of: stainless steel, aluminum, polyimide, polycarbonate, polyester, polyetherether ketone, polyetherimide, polyethersulfone, polysulfone, and liquid crystal polymer.

14. The fluid dispensing assembly of claim 12 wherein the compliant wall is adhesively attached to the manifold.

15. The fluid dispensing assembly of claim 12 wherein the compliant wall is attached with a thermoset adhesive.

16. The fluid dispensing assembly of claim 12 wherein the compliant wall is attached with a thermoplastic adhesive.

17. The fluid dispensing assembly of claim 12, wherein the compliant wall is adhered to the external manifold using an adhesive selected from the group consisting of: an acrylic thermo-set adhesive, acrylic, silicone, epoxy, bismaleimide, cyanoacrylate, polyimide and thermoplastic polyimide.

18. The fluid dispensing assembly of claim 12, wherein the external manifold comprises one of either a metal manifold or a molded polymer manifold.

19. The fluid dispensing assembly of claim 12, wherein the compliant wall includes openings for fluid ports from the reservoir.

20. A method of manufacturing a fluid dispensing assembly, comprising:

forming an external manifold having openings to receive fluid;

attaching a compliant wall to the external manifold such that the compliant wall seals the openings; and attaching the external manifold to a fluid dispensing subassembly wherein the fluid dispensing subassembly and manifold are on opposite sides of a transducer arranged to operate on the fluid in the manifolds.

21. The method of claim 20, wherein forming an external manifold comprises molding a polymer to have openings.

22. The method of claim 20, wherein attaching the compliant wall comprises using an adhesive.

23. The printhead of claim 20 wherein forming the external manifold further comprises molding and the compliant wall is attached through an insert molding process.

* * * * *